United States Patent [19]

Hosokoshi

[11] 4,186,326

[45] Jan. 29, 1980

[54] SHADOW MASK HAVING VERTICAL PITCH ABOUT 8/(2N−1) TIMES HORIZONTAL PITCH

[75] Inventor: Kakuichiro Hosokoshi, Neyagawa, Japan

[73] Assignee: Matsushita Electronics Corporation, Kadoma, Japan

[21] Appl. No.: 952,648

[22] Filed: Oct. 19, 1978

Related U.S. Application Data

[63] Continuation of Ser. No. 730,069, Oct. 6, 1976, which is a continuation of Ser. No. 603,511, Aug. 11, 1975, which is a continuation of Ser. No. 475,271, May 31, 1974, abandoned.

[30] Foreign Application Priority Data

Jun. 18, 1973 [JP] Japan ..... 48-69545

[51] Int. Cl.[2] ..... H01J 29/06; H01J 29/32

[52] U.S. Cl. ..... 313/408; 313/403; 313/470

[58] Field of Search ..... 313/403, 408, 477

[56] References Cited

U.S. PATENT DOCUMENTS

| | | | |
|---|---|---|---|
| 3,146,368 | 8/1964 | Fiore et al. | 313/408 |
| 3,247,412 | 4/1966 | Barneveld et al. | 313/403 |
| 3,569,760 | 3/1971 | Fargher | 313/470 |
| 3,633,058 | 1/1972 | Kuono | 313/403 |
| 3,663,854 | 5/1972 | Tsuneta et al. | 313/403 |
| 3,731,129 | 5/1973 | Tsuneta et al. | 313/408 |
| 3,766,419 | 10/1973 | Barbin | 313/408 |
| 3,900,757 | 8/1975 | Kaplan | 313/402 |
| 3,979,630 | 9/1976 | Ormer | 313/470 |

FOREIGN PATENT DOCUMENTS

| | | | |
|---|---|---|---|
| 2012046 | 3/1970 | Fed. Rep. of Germany | 313/403 |
| 2048158 | 1/1973 | Fed. Rep. of Germany . | |
| 1296307 | 11/1972 | United Kingdom . | |

OTHER PUBLICATIONS

Barbin & Hughes, "New Color Picture System for Portable TV Receivers," IEEE Transactions on Broadcast and Television Receivers, BTR-18, 1972; pp. 193-200.

*Primary Examiner*—Robert Segal
*Attorney, Agent, or Firm*—Cushman, Darby & Cushman

[57] ABSTRACT

A color picture tube, wherein a set of three electron beams emitted from respective three electron-emitting members of an electron gun, or from respective three electron guns, is projected onto a screen, and sets of each three luminous strips on this screen are selectively energized to emit luminous color lights, characterized in that the numeral ratios between said luminous strips by pieces and said slots of the shadow mask, respectively, are about 1:1 vertically and about 3:1 horizontally, and also that every strip as well as its set is complete insulated from adjacent strips and their sets by a light-absorbent film filling all the gaps inbetween.

With such construction, a color picture tube having excellent brightness and contrast characteristic, being free from disturbing vertical strips, has been obtained.

1 Claim, 5 Drawing Figures

SHADOW MASK HAVING VERTICAL PITCH ABOUT 8/(2N−1) TIMES HORIZONTAL PITCH

This is a continuation, of application Ser. No. 730,069, filed Oct. 6, 1976 which is a continuation of Ser. No. 603,511, filed Aug. 11, 1975, which is a continuation of Ser. No. 475,271, filed May 31, 1974 now abandoned.

BACKGROUND OF THE INVENTION

This invention relates to an improvement of a color picture tube, wherein a set of three electron beams for emitting red, green and blue lights, respectively, is emitted from a three-beam type electron gun, and passing through a vertically oblong slot of a shadow mask, is led to a black matrix-type screen standing behind the shadow mask so as to energize selectively any of three color-luminous strips which form a set of each three colors on said screen to correspond to said set of three electron color-beams and to produce desired color-lights.

Apertures of the shadow mask of the color picture tube of this type characterizing the vertically slotted mask as described above are formed in vertically oblong slots. Consequently, as compared with the ordinary-type color picture tubes employing masks having ordinary round apertures, it is already known that this type of tube can select larger ratio of apertures for the mask. Accordingly not only does it reduce electricity wastefully consumed by a portion of the electrons striking the mask and failing to pass through it, but also it is able to produce brighter pictures on the screen. Besides, it has the advantage of being almost free from color derangement in the vertical direction even in case of thermal expansion of the shadow mask.

However, in the known construction of this type of color picture tube, its screen has the form of massed vertical stripes of red, green and blue luminous strips alternately arranged to emit lights of the respective colors when energized. And furthermore, the light-absorbing film placed in the gaps between the luminous strips for the purpose of improving the contrast serves only to form vertical stripes on the screen. Therefore, it entails the shortcoming of deteriorating pictures coming out on the screen by distinct vertical stripes. Besides, the area covered by the light-absorbing film on the screen is not sufficient, and accordingly the improving effect on the contrast is not satisfactory either.

DETAILED DISCLOSURE OF THE PRESENT INVENTION

Figure 1:
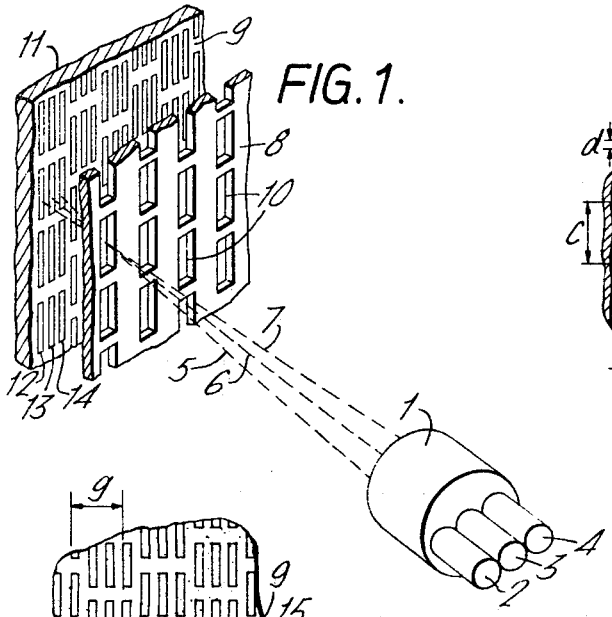
FIG. 1 is an enlarged perspective view of a part of the color picture tube embodying the present invention.

The present invention has been made in view of the foregoing points, of which explanation will be made in detail hereunder in conjunction with embodying examples shown in the drawing.

Shown in FIG. 1, an electron gun 1 is of a known "In-Line Gun Assembly" (Refer to U.S. Pat. No. 3,553,523 of Jan. 5, 1971) type having three electron-emitting members 2, 3 & 4 for emitting blue, red and green lights, respectively, which members are aligned with small spaces inbetween on a plane in horizontally deflecting directions. Electron beams 5, 6 & 7 for emitting blue, red and green luminous color-lights, respectively, from the electron gun 1 receive a deflection effect from a deflection means (not illustrated) and reach a screen 9 through a shadow mask 8 formed with a mildly convex surface.

Figure 2:
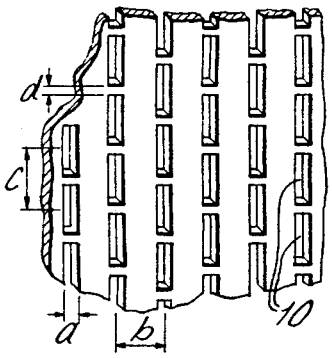
FIG. 2 is an enlarged perspective view of a part of the shadow mask for the color picture tube.

As shown in FIG. 2, the shadow mask 8 has numerous vertically oblong rectangular slots 10, 10, . . . arranged in multiple rows vertically and horizontally. The electron beams flattened by passing through these rectangular slots of the shadow mask produce each three vertically oblong rectangular spots per slot on a screen 9.

The size of slots 10, 10 . . . of the shadow mask 8 and the dimensions of gaps between each other vary depending on the size of the face plate of the tube. To take for instance a color picture tube having an 18-inch face plate (i.e. of the size with diagonal line of about 45 cm) designed in horizontal of 490 slots 10, 10 . . . , the relevant size and dimensions at the middle part of the tube are as follows:

Width (horizontal dimension) "a" of slot: 0.195 mm
Horizontal arrangement pitch "b" of slots: 0.7 mm
Vertical arrangement pitch "c" of slots: 0.9 mm
Bridge width "d": 0.13 mm The number of slots 10, 10 . . . in the horizontal arrangement is to be selected depending on the size of face plate of the tube, but it must be at least 300. The pitch "c" in the vertical arrangement of the slots is to be selected on the basis of 8/(2n−1) times the scanning-line pitch (where n is an integer), such as about 8 times, about 8/3 times, about 8/5 times or about 8/7 times the pitch. This mode of selection is advantageous in moderating the occurrence of adverse moire. The number of slots in the vertical arrangement is to be no less than 100. On the other hand, the bridge width "d" must be selected by considering the brightness of pictures, the mechanical strength of shadow mask, the occurrence of adverse moire, etc., but it should be selected to be no more than 30%, preferably to be no more than 20%., of the vertical length of a slot. Furthermore, it is desirable for the slots to be arranged in a horizontally zigzag fashion, though in vertically straight rows, as shown in the drawing, in consideration of said adverse moire and mechanical strength of the shadow mask.

Figure 3:
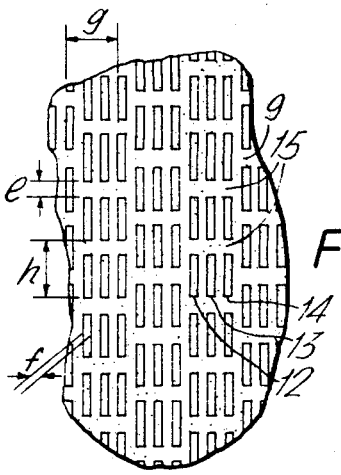
FIG. 3 is an enlarged plan view of a part of the screen of said color picture tube.

On the screen 9 which is a coated formation on the inner face of the face plate 11 of the tube, a large number of sets of phosphor strips (each set consisting of three vertically oblong strips 12, 13 & 14, aligned horizontally, to emit green, red and blue fluorescences, respectively) are orderly arranged both vertically and horizontally as shown in FIG. 3. And each luminous strip is completely surrounded by a light-absorbent film 15 which fills up entire gaps between strips as well as their sets. The three strips 12, 13 and 14 in each set are arranged with small gaps inbetween in the order, from left to right, of green, red and blue fluorescent phosphors, respectively, and this set arrangement is repeated in the same order in the vertical and horizontal rows of sets all over the face plate 11. Therefore, all strips on the left, middle and right rows of the entire strip sets emit respectively the same colored fluorescences. The three strips horizontally arranged in each set constitute a set of picture elements and jointly correspond to one of the slots 10 of the shadow mask. 8.

The light-absorbent film 15, as is well known, is made of graphite powder or the like and binding agent by applying the selective exposure method with the shadow mask 8 as a light-shielding mask. The light-absorbent film 15 is first coated on the inner surface of the face plate to form a film with apertures in vertical and horizontal rows, before forming the luminous trips. Therefore, the shape and positions of the sets of luminous strips under formation are defined by the apertures of the light absorbent film. Thus after completion of the tube, the light-absorbent film absorbs a part of undesirable outside light incident through the face plate and prevents deterioration of the contrast due to reflection from the film face.

The luminous strips 12, 13 and 14 are shaped rectangular about similar to each slot 10. Their vertical gap "e" corresponding to the bridge width "d" of the slots is to be set between 0.03 mm and 0.30 mm, preferably between 0.05 mm and 0.20 mm. A part of light-absorbent film covering this vertical gap between adjacent strips constitutes a horizontal bridge. Therefore, the light-absorbent film 15 forms a net pattern with numerous apertures in vertical and horizontal rows and covers a major part of the whole area of the screen At the same time, the bridges on the face plate divide the vertical stripes of luminous material into short strips by crossing horizontal rows thereof and acting as non-luminant multi-dividing belts. As a result, vertical stripes of the luminous strips and those of the light-absorbent film become almost obscure.

Now, examples of various dimensions concerning the luminous strips on the screen in correspondence to those already stated concerning the slots on the shadow mask, are given as follows:

Width "f" of luminous strip: 0.19 mm

Horizontal arrangement pitch "g" of strip set: 0.74 mm

Vertical arrangement pitch "h" of strips: 0.95 mm

Figure 4:
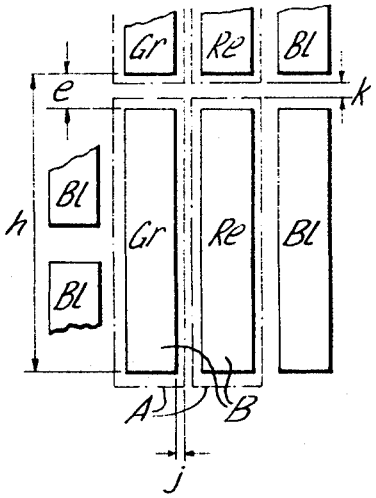
FIG. 4 is a chart showing the corelations between the luminous strips and the sections of electron beams on said screen.

FIG. 4 is an enlarged view exemplifying the relative dimensions between an area A showing the enclosure section of rectangular electron beams and the luminous strips B on the face of screen 9. Here, section A of rectangular electron beams is enlarged by 5% to 20% widthwise and lengthwise over the dimensions of slots 10, due to dispersion in relative distances between the shadow mask 8 and the screen 9. Against this, the width of luminous strips B is designed at a smaller value than the width of section A of the electron beams, and the width "j", which is the width of the horizontal guard-band, is designed to be 0.01 mm to 0.04 mm in the middle part of screen and to be 0.03 mm to 0.08 mm in the peripheral part of the screen. On the other hand, the length of luminous strips B is designed at a value equal to or slightly shorter than the length of section A of the electron beams, which value corresponds to about 0.9 to 1.2 times the length of the slots. Symbol "k" indicates the vertical gap of the electron beams on the screen.

Figure 5:
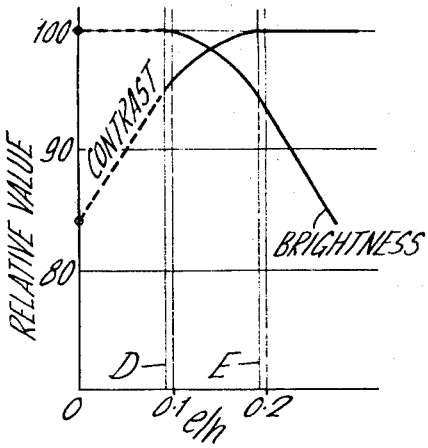
FIG. 5 is a characteristic chart for explaining the designing basis of said color picture tube.

FIG. 5 shows changes of the brightness of screen and the contrast value against e/h value in the picture tube of the aforementioned embodying example, wherein D indicates the e/h value when the vertical gap "e" of the luminous strips becomes equal with the vertical gap "k" of the electron beams on the screen, and E indicates the e/h value when the length of luminous strips almost becomes equal with the length of mask slots.

As is clear from the said chart, the most suitable e/h value from the aspects of both screen brightness and contrast lies in a region defined by the lines D and E. However, this value varies somewhat depending on the size of tubes, etc. Taking such into consideration, it has been proved by experiments that the optimum e/h value lies between 0.05 and 0.35, more desirably between 0.08 and 0.25.

As described above, according to the color picture tube of this invention, the multi-dividing belts of light-absorbent film are provided between each vertical arrangement of the sets of luminous strips to form horizontal zigzag stripes of non-luminant film. In other words, the total number of luminous strips in the horizontal arrangement is made about three times the corresponding number of slots on the shadow mask, and at the same time, the vertical number of the luminous strips is made about the same as that of the slots of shadow mask. In addition, all gaps between each and every luminous strip are filled up with the light-absorbent film. As a result, the color picture tube of this invention produces little undesirable stripes and can produce clear pictures on the screen.

Further improved effect can be obtained by selecting the vertical gap "e" of the luminous strips at a higher value than the vertical gap "k" of the electron beams (namely: $e \geqq k$) on the screen, and also by selecting the e/h value between 0.05 and 0.35 as mentioned before. On the other hand, the forms of slots and luminous strips need not necessarily be rectangular, but can, of course, be of other shapes so long as they are vertically slender.

What is claimed is:

1. In a color picture tube, wherein a set of three electron beams emitted from respective three electron-emitting members of an electron gun, or from respective three electron guns, is projected through rectangular slots of a shadow mask onto a screen, and sets of three luminous strips of differently colored phosphors located on the screen are selectively energized by the beams to emit luminous color lights, the improvement comprising the arrangement wherein the numerical ratios between the number of said luminous strips and said slots of the shadow mask, respectively, are about 1:1 vertically and about 3:1 horizontally, and every strip is completely insulated from adjacent strips of its set and those of the remaining sets by a light absorbent film filling all the gaps in between, each luminous strip being of a vertically oblong shape similar to that of each slot and being arranged in vertical alignment with strips of the same color phosphor, the vertical pitch of the luminous strips and of the slots being set to be about $8/(2n-1)$ times the scanning line pitch, wherein n is an integer, the vertical lengths of the luminous strips being selected between the value when the vertical gaps (e) between aligned luminous strips are equal to the vertical gaps (k) between successive horizontal scans of the electron beams on the screen, and a value roughly equal to the vertical lengths of the slots of the shadow mask, and the widths of the luminous strips (w) are less than the widths of sections of the electron beams on the screen.

* * * * *